United States Patent [19]

Gerber et al.

[11] Patent Number: 4,705,098

[45] Date of Patent: Nov. 10, 1987

[54] LABYRINTH ARTICULATION JOINT FOR REGENERATIVE AIR HEATER SEAL FRAME

[75] Inventors: David W. Gerber, Massillon; Frederick M. Untch, Canton, both of Ohio

[73] Assignee: The Babcock & Wilcox Company, New Orleans, La.

[21] Appl. No.: 859,278

[22] Filed: May 2, 1986

[51] Int. Cl.[4] ..... F28D 17/04

[52] U.S. Cl. ..... 165/4; 165/9

[58] Field of Search ..... 165/9, 4

[56] References Cited

U.S. PATENT DOCUMENTS 3,785,431 1/1974 Pettersen et al. ..... 165/9

*Primary Examiner*—Albert W. Davis, Jr.

*Attorney, Agent, or Firm*—Vytas R. Matas; Robert J. Edwards

[57] ABSTRACT

A labyrinth articulation joint (38) for use in the seal frame (35) of a rotary regenerative air heater (20). An internal labyrinth arrangement of intercooperating tabs (54,55) and slots (44,45) in the two hinges (41,51) of the labyrinth articulation joint (38) present a series of successive right angle turns that increases the pressure drop through the labyrinth articulation joint (38) thus reducing the leakage of air through the labyrinth articulation joint (38), and thereby minimizing erosion of the labyrinth articulation joint (38) due to abrasive particles that would otherwise be carried through the joint by the leakage air.

10 Claims, 10 Drawing Figures

LABYRINTH ARTICULATION JOINT FOR REGENERATIVE AIR HEATER SEAL FRAME

BACKGROUND OF THE INVENTION (1) Field of the Invention

The present invention relates in general to rotary regenerative air heaters for transferring waste heat from the flue gas exiting from a boiler to the incoming combustion air, and in particular to a new and novel labyrinth articulation joint for use in the seal frame of a rotary regenerative air heater.

(2) Description of the Related Art

In one type of rotary regenerative air heater, a cylindrical heat exchange mass and associated containment structure, called the stator, is positioned stationary between the inlets and outlets of the air and gas ducts. The stator is a radially compartmented steel shell packed with a multiplicity of plates that comprise the heating surface, arranged to provide an axial passage therethrough, such that the gas and air flow in an axial direction through the cylindrical heat exchange mass. The plates embody shapes, materials and thicknesses designed to provide optimum heat transfer, low pressure drop, corrosion resistance and ease of cleaning.

Air ducts at each axial end of the stator include air duct hoods, coaxially aligned with the cylindrical heat exchange mass, which are secured to a central drive shaft for coaxial rotation in relation to the cylindrical heat exchange mass. Each of the air duct hoods comprises a respective central flow inlet or outlet passage centrally mounted between, and in fluid communication with, two diametrically opposite hood segments or sectors for the passage of air to or from the heating mass. The hood segments of each of the air duct hoods are generally pie-shaped and diametrically and circumferentially spaced from each other. The air duct hoods, located at opposite ends of the heat exchange mass, rotate synchronously so that radial sectors of the mass of heat exchange plates and alternately exposed first to the hot flue gas exiting from the boiler and then to the incoming combustion air. The boiler flue gas heats the mass of heat exchange plates, whhich then transfer the heat to the cooler incoming combustion air in a continuous cycle of regenerative heating and cooling. By having two separate hood segments, the heating elements of the stator are thus exposed to two gas and two air cycles per revolution, thereby minimizing the swing in air heater "cold end" temperature during operation.

The gas ducts are arranged in a stationary position at the opposite ends of the stator and surround the rotating air duct hoods. The gas ducts direct the incoming boiler flue gas past the rotating air duct hoods and through those portions of the mass of heat exchange plates in the stator that are not covered by the rotating air duct hoods at any given time.

Since two separate moving fluid streams are arranged to alternately pass over a stationary common area (i.e. the heating surface in the stator), means for preventing intermixing of these streams at other locations must be provided. Prevention of this intermixing of the fluid streams is complicated, however, by the thermally-induced distortion of the stator during operation. Briefly, due to the temperature difference between the "hot end" (gas inlet/air outlet) side and "cold end" (gas outlet/air inlet) side of the air heater during operation, the "hot end" side of the air heater becomes convex, while the "cold end" side of the air heater becomes concave. Any sealing mechanism, then, must be able to accommodate this distortion. Sealing between the stationary stator and the rotating air duct hoods is thus achieved by sealing strips that are attached to articulating seal frames. These articulating seal frames are spring mounted to the rotating air duct hoods, and allow the sealing strips to conform to the curvature of the stator surface and maintain an effective seal between the relatively high pressure "air side" of the air heater and the relatively low pressure "gas side" of the air heater. The articulating seal frames utilize articulating joints located in the radial portions of the seal frames to accommodate the above-described thermally induced stator distortion. An expansion joint is connected between the seal frame and the air duct hoods to partially accommodate the relative thermal displacement of these elements, as well.

The gas and air flow through the rotary regenerative air heater is usually accomplished by fan means. Due to the air heater's position in the air/gas paths of the boiler, the air side of the air heater is generally at a higher operating pressure than the gas side of the air heater, as was indicated above. Since, in a rotary regenerative air heater, the heating surface is alternately exposed to the gas and air streams, separated at any given instant at the sliding interface by the above-described sealing strips, a potential for leakage from the air side to the gas side is always present. This leakage is detrimental to the air heater. The flue gas exiting from a boiler, especially in a coal-fired installation, contains highly erosive particles, most notably silica, that eventually find their way to the air heater. As the hoods rotate over the stator, thereby alternately passing air through heating surface where particle entrained flue gas had been present only moments before, entrainment of some of these particles in the air stream becomes inevitable. Since the air side of the air heater operates at a higher pressure than the gas side, any leakage air containing these particles "sandblasts" or erodes any surface over which it passes. It has been discovered that some currently operating air heaters, especially those at boiler installations firing high silica lignite coal fuels, have been experiencing severe erosion at the very articulating joints that enable the seal frames and attached sealing strips to conform to the curvature of the stator. Analysis of the problem revealed that the "old style" articulating joint, while permitting the proper degree of flexion for sealing, did so by leaving a straight-through, unobstructed gap at the center of the joint, thereby allowing leakage air to pass through and erode the joint. Left unchecked, erosion of these articulating joints can lead to the structural failure of the sealing frame and damage to the stator and sealing strips. Since repair/replacement of a damaged articulating joint requires removing the affected air heater from service, utilities are reluctant to have a unit "down" for any extended period of time. Further, since the problem was occurring at operating air heater installations, any solution to the problem had to fit within the confines of the existing seal frame structure, which was essentially two wide flange structural members connected end-to-end at the articulating joint. A redesign of the entire seal frame was unacceptable in terms of time and cost.

The use of articulating joints, per se, to enhance the sealing between a stator and a rotating surface is known in the art. Penny (U.S. Pat. No. 3,882,927) teaches an articulating seal for a rotary regenerative heat exchanger, (which could be generally described as a "block-channel" design) having a plurality of blocks arranged end-to-end in a guide housing, that form the pivoting articulating joints of the seal. One of the adjacent end faces of the blocks may be of cylindrical concave shape and the adjacent end of the cooperating block may be of complimentary cylindrical convex shape. Other embodiments show both adjacent end faces of the articulating joint to have a concave cylindrical shape, a cylindrical roller being positioned between the blocks and located in the concave end faces, or the use of a knuckle joint design/hinge pin arrangement. Spring means or fluid pressure acting in the space between the blocks and the guide housing act to urge the blocks against the matrix disc of the air heater. Pereira (U.S. Pat. No. 4,185,686) also teaches a sealing apparatus of the above-described "block-channel" design, for use in a rotary regenerative heat exchanger, that also allows for articulation along the length of the seal by means of tongue and groove joints for interengagement. Guillot (U.S. Pat. No. 4,024,905) and Handa (U.S. Pat. No. 4,084,634) also teach block-channel seal configurations; Guillot using U-shaped compression members disposed within U-shaped shoes while Handa uses rectangularly shaped friction shoes that are biased into sliding contact with one of the walls of the groove by a springy plate. Both the articulating members themselves and the channels/grooves associated therewith are used to effect sealing. Gignac (U.S. Pat. No. 3,703,297) teaches an articulates link seal assembly comprised of a plurality of modular seal blocks of resilient elastomer material, used to seal one pipe or conduit to another, or to a wall opening or the like. The ends of the seal blocks are similar to those described in Penny, supra, except that two pressure plates (mounted at the sides of the blocks) and two bolts are used to interconnect them. When the seal assembly is wrapped around a first conduit, axial compression of the bolts causes the elastomeric material to expand circumferentially and seal against a second conduit or wall into which the first conduit is inserted. No mention is made, however, of permitting relative movement between the two sealed together elements—in fact, the application of the invention would suggest that such relative movement is undesirable.

It has thus become desirable to develop an improved articulation joint for use in the seal frame of a rotary regenerative air heater. Such an articulation joint must easily replace the "old style" articulating joint, provide for the same degree of flexion of the seal frame in which it would be installed, and yet reduce/eliminate the erosive leakage problem at the joint.

SUMMARY OF THE INVENTION

The present invention provides a new and novel labyrinth articulation joint for use in the seal frame of a rotary regenerative air heater. By providing an internal labyrinth arrangement of intercooperating tabs and slots in the two halves of the joint, leakage of air from the air side to the gas side of the air heater is reduced, since the normally present straight-through leakage path is now broken up into a series of succesive right angle turns that increases the pressure drop through the joint. Erosion damage to the joint itself is thus minimized, while still maintaining the capability of the articulation joint itself to conform to the thermally distorted surface of the stator during operation.

Accordingly, one aspect of the present invention is to provide a labyrinth articulation joint for the seal frame of a rotary regenerative air heater that is easily field installed as a replacement assembly in existing air heaters.

Another aspect of the present invention is to provide a labyrinth articulation joint for the seal frame of a rotary regenerative air heater that provides for articulation of the seal frame of which it is a part, such that the seal frame and attached sealing strip can conform to the surface of the stator over which it passes.

Still another aspect of the present invention is to provide a labyrinth articulation joint for the seal frame of a rotary regenerative air heater that also provides for reduced leakage of air across said joint from the air side to the gas side of the air heater.

Yet still another aspect of the present invention is to provide a labyrinth articulation joint for the seal frame of a rotary regenerative air heater that also provides for reduced erosion of said joint by air-entrained abrasive particles.

The various features of novelty which characterize the present invention are pointed out with particularity in the claims annexed to and forming a part of this disclosure. For a better understanding of the present invention, its operating advantages and specific results attained by its uses, reference is made to the accompanying drawings and descriptive matter in which a preferred embodiment of the present invention is illustrated.

DESCRIPTION OF THE PREFERRED EMBODIMENTS

Figure 1:
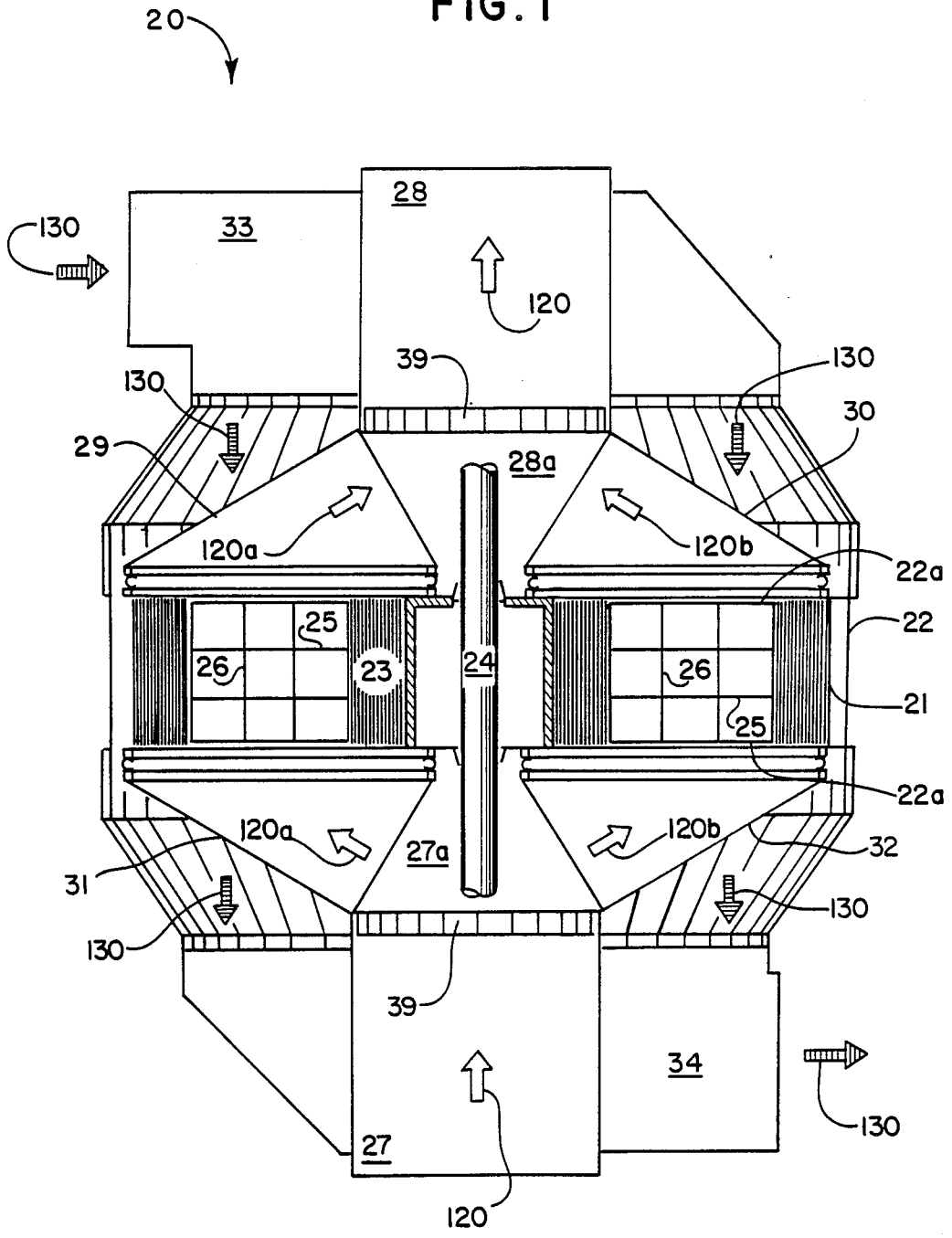
FIG. 1 is an axial sectional view of a rotary regenerative air heater.
Figure 2:
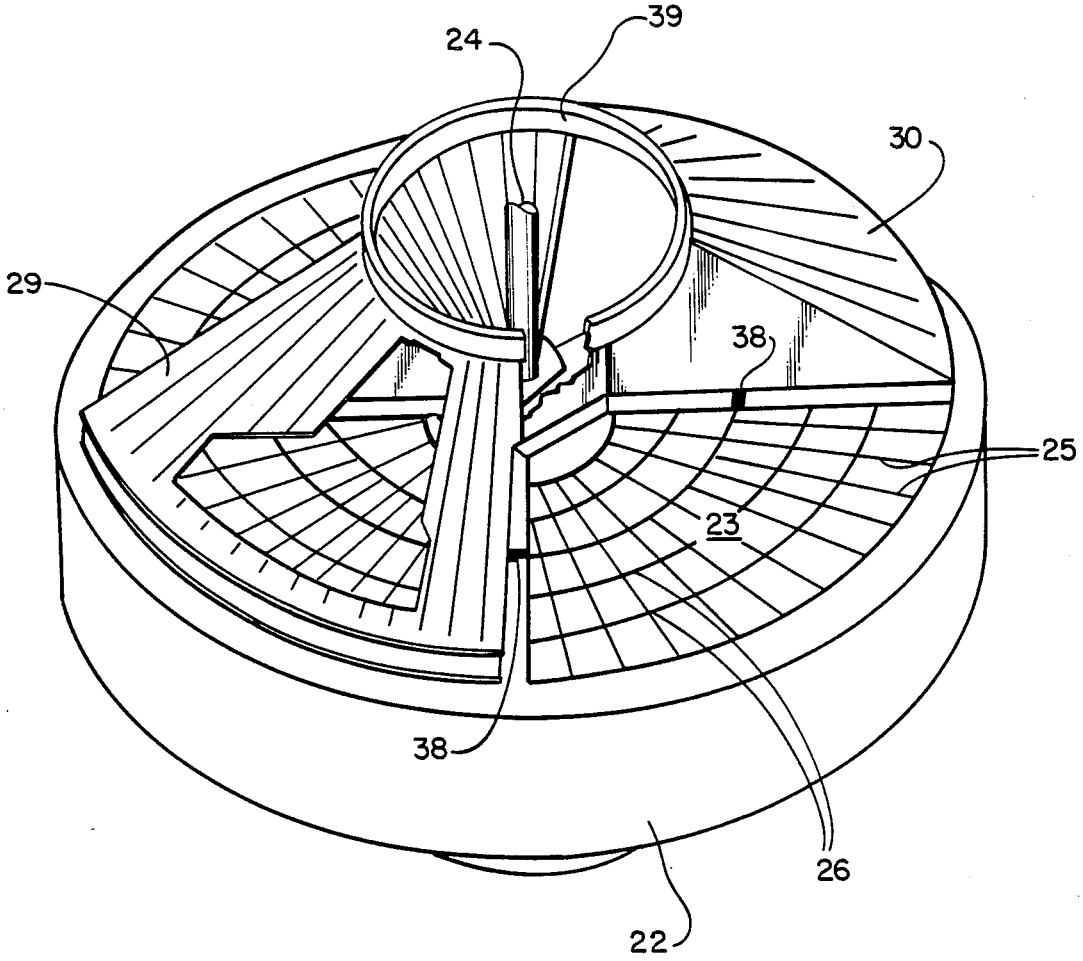
FIG. 2 is a schematic perspective view of the rotary regenerative air heater of FIG. 1, with the outer surface of a hood segment partly broken away, to illustrate the stator, the rotating air hoods, and schematic locations of the labyrinth articulation joint of the present invention.
Figure 3:
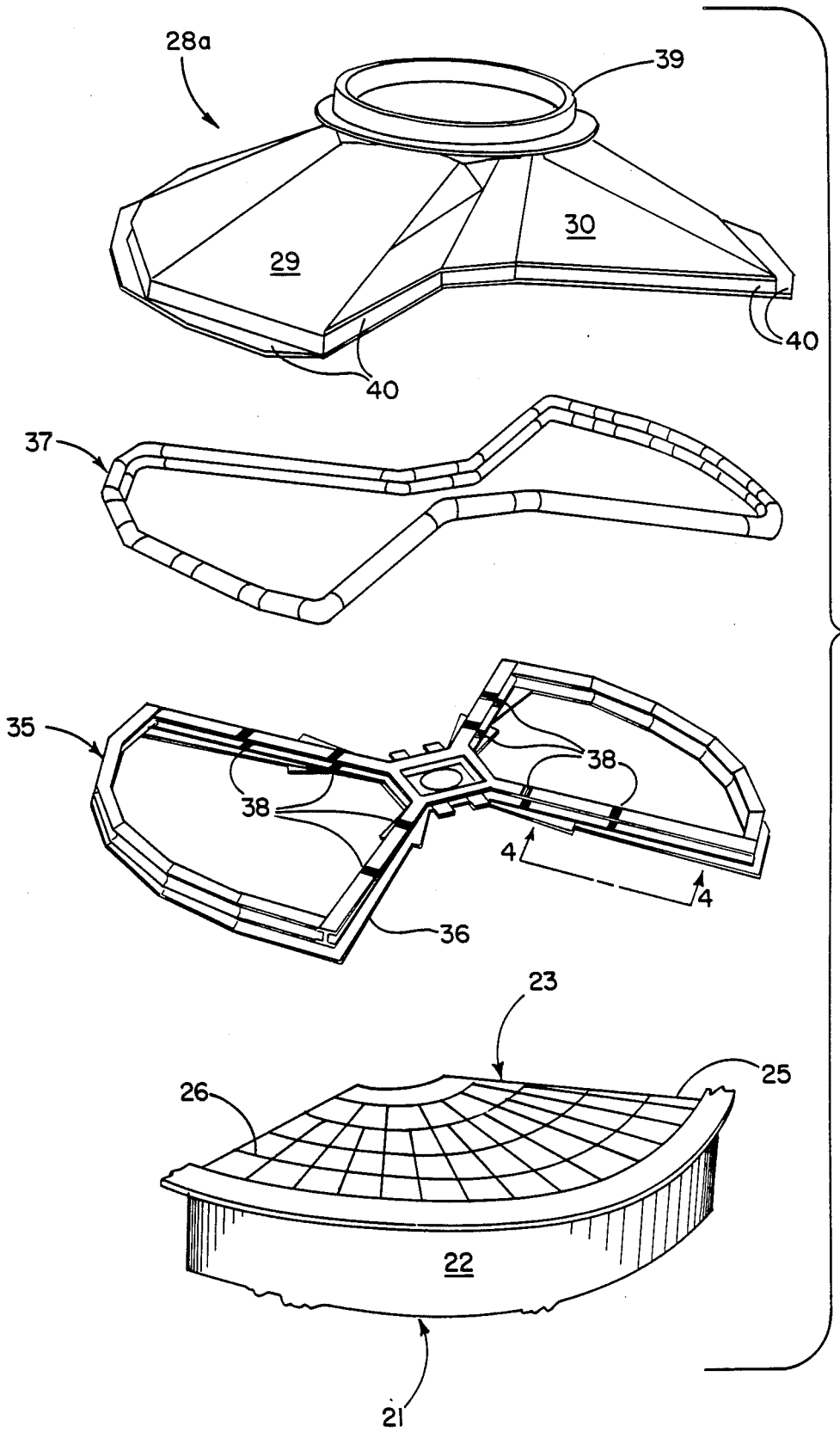
FIG. 3 is a schematic exploded view of FIG. 2, showing the primary components of a rotary regenerative air heater.
Figures 4, 5, 6, 7, 8, 9, 10:
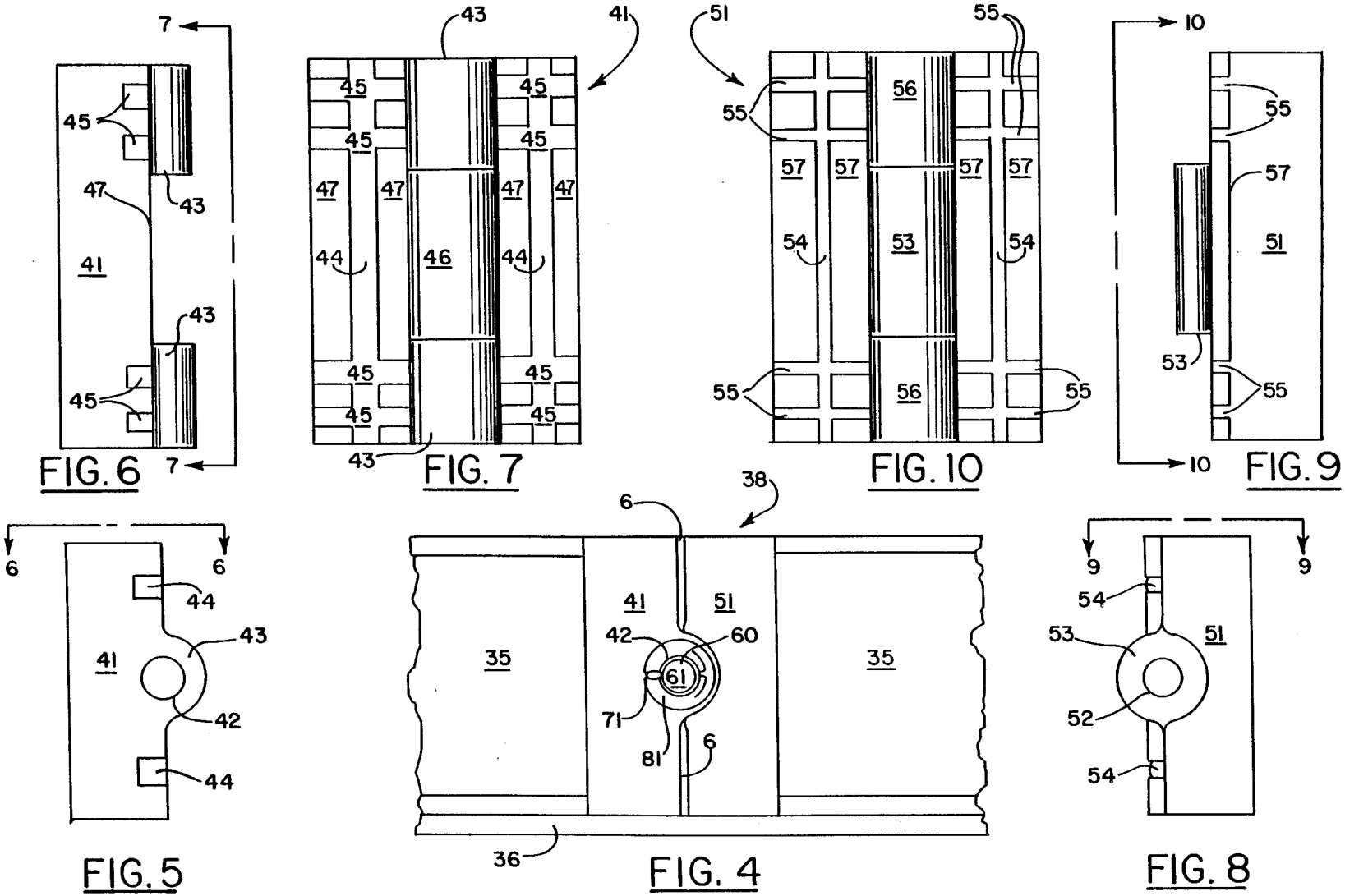
FIG. 4 is a partial sectional view of the labyrinth articulation joint of the present invention, taken along line 4—4 of FIG. 3.
FIG. 5 is a left side view of the first hinge subassembly of the labyrinth articulation joint of the present invention.
FIG. 6 is a plan view taken along line 6—6 of FIG. 5.
FIG. 7 is an end view taken along line 7—7 of FIG. 6.
FIG. 8 is a right side view of the second hinge subassembly of the labyrinth articulation joint of the present invention.
FIG. 9 is a plan view taken along line 9—9 of FIG. 8.
FIG. 10 is an end view taken along line 10—10 of FIG. 9.

Referring to the drawings generally and to FIGS. 1, 2 and 3 in particular, wherein like numerals designate the same element throughout the several drawings, there is shown a rotary regenerative air heater 20. It is to be noted that while the following detailed description is presented in the context of a rotary regenerative air heater 20 having a vertical central shaft 24, it is to be understood that the present invention could be used in the a seal frame of a horizontal shaft rotary regenerative air heater (not shown).

The rotary regenerative air heater 20 includes a stator 21 which comprises an open-ended cylindrical shell 22 having cylindrical end faces 22*a*, and a heat exchange mass 23 mounted within said shell 22, both being disposed about a central vertical axis. The heat exchange mass 23 is comprised of multiple plates (not shown) that extend radially from the vertical central shaft 24 to the shell 22, and are closely circumferentially spaced and segmented into groups of baskets (not shown). These baskets are mounted intermediate of radial wall partitions 25 and chordal wall partitions 26. The baskets are radially and circumferentially arranged around the vertical central shaft 24 to complete a circle of air heater heating surface.

Air inlet and outlet ducts 27 and 28, respectively, are provided at each end of the shell 22. The air inlet duct 27 and air outlet duct 28 include air inlet and outlet hoods 27*a*, 28*a* that are co-axially secured to the vertical central shaft 24 for rotation, with the shaft, relative to the stationary heat exchange means 23 by drive means (not shown). Each of the air inlet and outlet hoods 27*a*, 28*a* have diametrically opposed sectors 31,32 and 29,30, respectively. Stationary gas inlet and outlet ducts 33,34, are arranged around the respective air outlet hood sectors 29, 30 and air inlet hood sectors 31, 32.

Referring to FIGS. 1 and 2, and as illustrated by flow arrow 120, combustion air enters the rotary regenerative air heater 20 through a first central collar 39 of air inlet duct 27 and is then split into two axial air streams 120*a* and 120*b* which pass into the diametrically opposed sectors 31, 32, respectively. These two axial air streams 120*a* and 120*b* pass through the circumferentially spaced baskets (not shown) of the heat exchange mass 23 and into axially opposite and diametrically opposed sectors 29 and 30. The two air streams 120*a* and 120*b* are then merged together into the full air stream 120 and discharged through a second central collar 39 and thence through air outlet duct 28. Flue gas, as illustrated by flow arrow 130, passes through the rotary regenerative air heater 20 in substantially counterflow relationship with respect to the incoming combustion air stream 120. The flue gas stream 130 enters the rotary regenerative air heater 20 via gas inlet duct 33 and initially passes over the outer surfaces of the air outlet hoods 29, 30 and then into those portions of the heat exchange mass 23 which, at that time, are not axially aligned and in fluid communication with the air inlet hood sectors 31, 32. The flue gas stream 130 then exits from the heat exchange mass 23 and is discharged via gas outlet duct 34.

Referring to FIG. 3, a schematic exploded view of the primary components of the rotary regenerative air heater 20, seal frame 35 is operatively disposed along the peripheries of the air outlet duct hoods 29, 30, and supports the sealing strip 36. The seal frame 35 is an endless member and carries the sealing strip 36 in sliding contact against the surface of the stationary heat exchange mass 23 to maintain a seal between the air streams 120 and gas streams 130 that continually pass through the rotary regenerative air heater 20 during operation. The seal frame 35 is operatively interconnected in the axial space between the seal frame 35 and the hood frame 40 by means of a linkage (not shown) that provides for coplanar movement of the seal frame 35 with respect to the hood frame 40. Each hood frame 40, which is part of a respective one of the air duct hoods 27*a*, 28*a* is also flexibly connected to the seal frame 35 by an expansion joint 37 that has a U-shaped cross-section. It is to be noted that the above-described structure and function is also employed between the heat exchange mass 23 and the air inlet hoods 31, 32 located on the underside of the rotary regenerative air heater 20.

In accordance with the present invention, and as shown schematically in FIGS. 2 and 3, a labyrinth articulation joint 38 is located in the radial sections of the seal frame 35. The number of labyrinth articulation joints 38 used in a given radial section of the seal frame 35 depends on the diameter of the rotary regenerative air heater 20. Two or three labyrinth articulation joints 38 can be used in a given radial section of the seal frame 35. With this in mind, the following discussion will address the design of a single labyrinth articulation joint 38 according to the present invention.

Turning now to FIGS. 4 through 10, there is shown (in FIG. 4) a partial sectional view of the labyrinth articulation joint 38, as located in a seal frame 35, when viewed along line 4—4 of FIG. 3. It will be noted that the general arrangement of the associated FIGS. 5–10 surrounding FIG. 4 have been placed in positions relative to each other to indicate how the labyrinth articulation joint 38 is assembled. To facilitate the description of the labyrinth articulation joint 38, or any part thereof, the "height" will be defined as the vertical dimension of FIGS. 4, 5, and 8; the "width" will be defined as the horizontal dimension of FIGS. 4, 5, and 8; and "depth" or "transverse" will be defined as being mutually perpendicular to the height and width.

The labyrinth articulation joint 38 is comprised of two subassemblies, a left hinge 41 and a right hinge 51, that are removably coupled together by a pin 61 which passes completely through the labyrinth articulation joint 38. To prevent the pin 61 from disengaging from the labyrinth articulation joint 38, the ends 60 of the pin 61 extend approximately 1" in the transverse direction past the sides of the labyrinth articulation joint 38 and are secured at each of said ends 60 by a washer 81 and a cotter pin 71. The cotter pin 71 passes through a hole (not shown) near each end 60 of the pin 61 and lying along a diameter of the pin 61, thereby holding the washer 81 in place. The overall dimensions of the assembled labyrinth articulation joint 38, in a preferred embodiment, are height: 6⅜"; width: 4-1/16"; and depth: 10". These dimensions can be adjusted to suit the size of a particular seal frame 35, which is generally a 6" or 8" wide flange beam. The material of the labyrinth articulation joint 38 and the pin 61 is mild steel; grades SA-216-WCB and AISI C-1018, respectively. Installing the labyrinth articulation joint 38 in the field requires the left hinge 41 and the right hinge 51 to be welded or otherwise secured to the seal frame 35.

The left hinge 41 has two journals 43, each partially extending from the outer sides of the left hinge 41 towards the middle thereof. A semicircular channel 46 between these two journals 43 is adapted to closely receive a single complimentary journal 53 located in the right hinge 51. Similarly, the right hinge 51 has two semicircular channels 56 that are adapted to closely receive the two journals 43 of the left hinge 41. Each journal 43 contains a hole 42 completely passing therethrough; both holes 42 share the same common transverse axis of symmetry and are adapted to closely receive the pin 61 passing therethrough. A journal 53 also contains a hole 52, adapted to closely receive the pin 61 completely passing therethrough as well.

In assembling the labyrinth articulation joint 38, the journal 53 of the right hinge 51 is inserted between the journals 43 of the left hinge 41, such that a gap G is of a dimension of approximately 1/16". The holes 42 and 52 will then define a substantially continuous hole of a single diameter, which will permit the pin 61 to pass completely therethrough and removably couple the left hinge 41 to the right hinge 51. The gap G is chosen at the above dimension to provide a sufficient degree of flexion at the labyrinth articulation joint 38, and consequently for the seal frame 35.

In addition to the complementary journals 43 and 53, the left hinge 41 has an internal labyrinth arrangement of transverse slots 44 and mutually perpendicular slots 45. These slots 44, 45 are adapted to receive a complementary internal labyrinth arrangement of transverse tabs 54 and mutually perpendicular tabs 55 that are found in the right hinge 51. When the right hinge 51 is assembled and pinned into the left hinge 41 (as described above) leakage air attempting to pass from one side of seal frame 35 to the other side through the gap G will now face a succession of right angle turns, which increase the pressure drop across the labyrinth articulation joint 38, thereby minimizing the leakage across the labyrinth articulation joint 38 and the resulting erosion that can occur. Preferred dimensions of the tabs 54,55 are ⅜" thick and extending ⅜" above the surface 57 of the right hinge 51. Preferred dimensions for the slots 44,45 are ½" across and extending ½" below the surface 47 of the left hinge 41. As was the case of the choice of dimension for the gap G, these dimensions will likewise permit sufficient articulation of the labyrinth articulation joint 38 and yet reduce the leakage of air through and erosion of same.

While a specific embodiment of the present invention has been shown and described in detail to illustrate the application of the principles of the invention, certain modifications and improvements will occur to those skilled in the art upon reading the foregoing description. By way of example, the number and size of intercooperating tabs and slots used can be modified. The tabs and slots can be made in a wavy, zigzag or arcuate pattern to further enhance the tortuousness of the pathway that any leakage air could take. Similarly, the number and arrangement of intercooperating journals used could be adjusted to suit a given application. It should be understood that all such modifications and improvements have been deleted herein for the sake of conciseness and readibility but are properly within the scope of the following claims.

What is claimed as new and desired to be secured by Letters Patent of the United States is:

1. An articulation joint mountable in the radial arms of a seal frame of a rotary regenerative air heater used to transfer heat from the gas side to the air side of said heater to permit said seal frame to conform to the surface of the stator of said air heater, comprising:

a first hinge, having an internal labyrinth arrangement of tabs;

a second hinge, having an internal labyrinth arrangement of slots adapted to closely receive and intercooperate with the internal labyrinth arrangement of tabs on the first hinge, such that a succession of right angle turns is presented to air attempting to leak through the articulation joint, thereby minimizing leakage of the air through the joint and erosion of the joint from abrasive particles entrained in the air; and means for removably coupling said first hinge to said second hinge.

2. Apparatus as set forth in claim 1 wherein said means for removably coupling said first hinge to said second hinge comprise:

a cylindrical pin having a transverse diametral hole at each end;

complementary intercooperating journals located in said first hinge and said second hinge having holes adapted to rotatably receive said cylindrical pin; and means for preventing disengagement of said pin from said articulation joint.

3. Apparatus as set forth in claim 2 wherein said means for preventing disengagement of said pin from said articulation joint comprise:

two washers adapted to receive said cylindrical pin and located outboard of said articulation joint when said pin is inserted in the holes of the journals located in said first and said second hinge of said articulation joint; and two cotter pins adapted for insertion into said transverse diametral holes located at said ends of said cylindrical pin such that said washers are prevented from disengaging from said cylindrical pin when said cotter pins are inserted into said transverse diametral holes.

4. Apparatus as set forth in claim 1 wherein said first hinge and said second hinge are made of SA-216-WCB steel.

5. Apparatus as set forth in claim 2 wherein said cylindrical pin is made of AISI C-1018 steel.

6. Apparatus as set forth in claim 1, wherein said tabs in said first hinge are ⅜" thick and extend ⅜" above the surface of said first hinge.

7. Apparatus as set forth in claim 1 wherein said slots in said second hinge are ½" across and extend ½" below the surface of said second hinge.

8. An articulation joint mountable in the radial arms of a seal frame of a rotary regenerative air heater used to transfer heat from the gas side to the air side of the heater to permit the seal frame to conform to the surface of the stator of the air heater, comprising:

a first hinge;

a second hinge;

means for removably coupling the first hinge to the second hinge; and means, located internally on the first and second hinges, for presenting a succession of right angle turns to air attempting to leak through the joint across the height, width and depth thereof to minimize leakage of air from the air side to the gas side of the air heater through the articulation joint and erosion of the joint from abrasive particles entrained in the air.

9. Apparatus as set forth in claim 8, wherein the means located internally on the first and second hinges presenting a succession of right angle turns to air attempting to leak through the articulation joint comprise:

an internal labyrinth arrangement of tabs in the first hinge; and an internal labyrinth arrangement of slots in the second hinge, the slots being adapted to closely receive and intercooperate with the internal labyrinth arrangement of tabs on the first hinge.

10. A rotary regenerative air heater used to transfer heat between a stream of gas flowing through the air heater and a stream of air flowing through the air heater, comprising:

a stator including an open-ended cylindrical shell containing a stationary heat exchange mass, the shell and the heat exchange mass being disposed about a central shaft;

air inlet and outlet hoods, each being co-axially secured to the central shaft at opposite ends of the open-ended cylindrical shell for rotation therewith relative to the stationary heat exchange mass, for directing the stream of air through the hoods and the stationary heat exchange mass;

gas inlet and outlet ducts, located at opposite ends of the open-ended cylindrical shell, for directing the stream of gas past the air hoods and through those portions of the heat exchange mass not covered by the rotating hoods;

seal frames, disposed along a periphery of the air inlet and outlet hoods and flexibly connected thereto, for supporting and carrying a sealing strip in sliding contact against a surface of the stationary heat exchange mass to maintain a seal between the air stream and the gas stream; and articulating joints, disposed in radial sections of the seal frames, to permit the seal frame to conform to the surface of the stationary heat exchange mass of the stator, the articulating joints having an internal labyrinth arrangement of intercooperating tabs and slots that present a succession of right angle turns to air attempting to leak through the articulation joint, thereby minimizing leakage of air through the joint and erosion of the joint from abrasive particles entrained in the air.

* * * * *